US005349969A

United States Patent [19]

Price

[11] Patent Number: 5,349,969

[45] Date of Patent: Sep. 27, 1994

[54] NAIL FILE PROTECTOR DEVICE

[76] Inventor: Trudy Price, 6755 Green Hill Dr., Evansville, Ind. 47711

[21] Appl. No.: 35,990

[22] Filed: Mar. 23, 1993

[51] Int. Cl.[5] ..... A45D 79/18

[52] U.S. Cl. ..... 132/76.5; 132/76.4

[58] Field of Search ..... 132/75.6, 76.4, 76.5

[56] References Cited

U.S. PATENT DOCUMENTS

| | | | |
|---|---|---|---|
| D. 158,280 | 4/1950 | Heineman | 132/76.5 |
| 1,766,321 | 6/1930 | Arthur | 132/76.5 |
| 1,897,754 | 2/1933 | Farris | 132/76.5 |
| 2,019,580 | 11/1935 | Poux | 132/76.4 |
| 2,376,946 | 5/1945 | Stinson | 132/76.5 |
| 3,339,562 | 9/1967 | Rowe | 132/76.5 |

FOREIGN PATENT DOCUMENTS

| | | | |
|---|---|---|---|
| 2101341 | 7/1972 | Fed. Rep. of Germany | 132/76.5 |
| 258462 | 5/1949 | Switzerland | 132/76.5 |
| 865060 | 4/1961 | United Kingdom | 132/76.4 |

*Primary Examiner*—Gene Mancene
*Assistant Examiner*—Frank A. LaViola

[57] ABSTRACT

A nail file holder device of strong molded material, having a vertical extension of the same width and thickness of a standard nail file that provides a means for protecting, maintaining and conserving said standard nail file.

2 Claims, 1 Drawing Sheet

NAIL FILE PROTECTOR DEVICE

BACKGROUND OF THE INVENTION

1. Field of the Invention.

The present invention relates in general to nail files and in particular to a device for protecting, maintaining and conserving nail files. More specifically, the present invention relates to a device (hereinafter referred to as the "File-Saver"), used in protecting, supporting and maintaining nail files from premature breaking or cracking.

2. Prior Art.

No device is known, or known to be similar to, the File-Saver, or have the advantages of this invention.

SUMMARY OF THE INVENTION

The principal object of the File-Saver, is to provide a solution to the problem faced by nail file users, whether such users are nail care professionals or non-professionals (hereinafter a nail care professional or non-professional will be referred to as a "User"). Currently, a nail file will crack or break well before the nail file is worn. This problem is caused by the pressure placed up on nail files (normally the center of the nail file) by the User while such nail file is in use. Therefore, due to such cracking or breaking, a nail file is discarded by a User before it has been completely wore down. To the professional and non-professional nail file user, this problem is not only annoying but causes additional operating expenses due to constantly replacing broken or cracked nail files.

Nail file suppliers have attempted to solve this problem by "re-shaping" nail files so that the pressure typically placed on a nail file during use is not concentrated to one location on the nail file. However, such "re-shaping" has proved inadequate to the User, and nail files continue to crack and break after little use. No device is known or known to be similar to the File-Saver, nor does any device offer the advantages of the present invention.

The File-Saver is a device which provides the necessary support to the nail file thus solving the problem of premature nail file breaking and cracking. As such, the File-Saver gives the User the advantage of fully utilizing the nail file before having to discard or replace it. This will save the User both time and expense. As will be discussed, the foregoing is accomplished with the File-Saver by providing a device for the nail file to fit snugly in, exposing only a quarter section of the nail file for filing purposes. A part of the device consists of a vertical extension the width of a nail file which extends from behind the exposed part of the nail file, and provides the support to the nail file while in use. This extension prevents the nail file from bending excessively to the point of breaking or cracking from pressure while the nail file is being used. When the exposed portion of the nail file is worn, the User merely exposes a new quarter section of such file. The nail file is not discarded until all four (4) quarter sections of such nail file are worn. The File-Saver is manufactured for any standard size nail file.

BRIEF DESCRIPTION OF THE DRAWING

For a more complete understanding of the File-Saver and the advantages thereof, reference is now made to the following Description, taken in conjunction with the accompanying Drawing in which.

REFERENCE NUMERALS IN DRAWING

10 Base-Handle of File-Saver ("Base-Handle")

14 Left-Side-Panel of Base-handle ("Left-Side-Panel")

15 Right-Side-Panel of Base-Handle ("Right-Side-Panel")

16 Top-Panel of the Base-Handle ("Top-Panel")

17 Bottom-Panel of the Base-Handle ("Bottom-Panel")

18 Rear-Panel of the Base-Handle ("Rear-Panel")

20 Support-Extension from Base-Handle ("Support-Extension")

30 Slot (also referred to as "Slot-Opening", which is that opening within the Base-Handle wherein a nail file is inserted for use)

35 Oval Opening within the Center of the Base-Handle ("Oval-Opening")

40 A nail file

DETAILED DESCRIPTION

Figure 1:
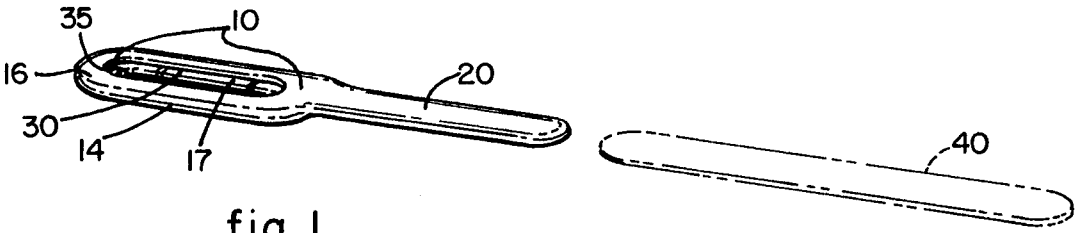
FIG. 1 illustrates a three-dimensional view of the top side of the File-Saver.

Referring first to FIG. 1, the File-Saver there illustrated includes a Base-Handle (10), of elongated oval shape which preferably is of strong molded material. Attached to the Base-Handle (10) is a Left-Side-Panel (14), Right-Side-Panel (not specifically shown in FIG. 1), Top-Panel (16) and Bottom-Panel (17). The exterior of the Base-Handle (10), namely the Left-Side-Panel (14), Right-Side-Panel, Top-Panel (16) and Bottom-Panel (17), are attached and formed with curved edges for comfort when holding and using the File-Saver. Said Top-Panel, Bottom-Panel, Left-Side-Panel and Right-Side-Panel make up the Base-Handle (10), and are connected and formed to create a Slot (30) sized to fit, wherein a portion of the nail file (40) fits snugly while in use.

In order to better illustrate the Base-Handle (10) of the File-Saver, a nail file (40) in FIG. 1, is inserted in the Slot (30) of the Base-Handle (10). The Slot (30) within the Base-Handle (10) is illustrated in FIG. 1 as the cavity within the Base-Handle (10), and between the Top-Panel (16) and the Bottom-Panel (17). This Slot (30) is sized in order for a nail file (40) to fit snugly within. As will be reflected on the drawing, approximately one-half ($\frac{1}{2}$) of the nail file (40) is inserted in the Base-Handle's slot (30).

You will note, and as will be reflected in the drawing, the Base-Handle (10) has an Oval-Opening (35) within the approximate center of the Top-Panel (16) and Bottom-Panel (17), thereby creating identical holes in the Top-Panel (16) and Bottom-Panel (17), of the Base-Handle (10). This Oval-Opening (35) serves to expose a portion of the nail file (40) while the nail file (40) is inserted in the Base-Handle (10), thereby giving access of said inserted nail file (40) to the User once it has been inserted into the File-Saver's Slot (30). The Oval-Opening (35) provides the User a means to control the nail file (40) and stabilize the nail file (40) while in use. The width of this Oval-Opening (35) is slightly less than the width of the inserted nail file (40) to avoid such nail file (40) from slipping out of the Base-Handle (10) through the Oval-Opening (35).

Extending from the Base-Handle (10) in FIG. 1 is a Support-Extension (20) of the File-Saver. The Support-Extension (20) provides support to a nail file (40) when such nail file (40) is inserted in the File-Saver and being used, by providing a brace for the back of the exposed quarter section of the nail file (40). The Support-Extension (20) is shaped like a nail file (40) in order to accurately and fully support a nail file (40) while in use. The Support-Extension (20) is approximately the same thickness as a nail file (40) and, like the Base-Handle (10), is made of a strong molded plastic material. Once the nail file (40) is inserted in the Base-Handle (10), the nail file (40) extends slightly beyond the Support-Extension (20) as shown in FIG. 2.

Figure 2:
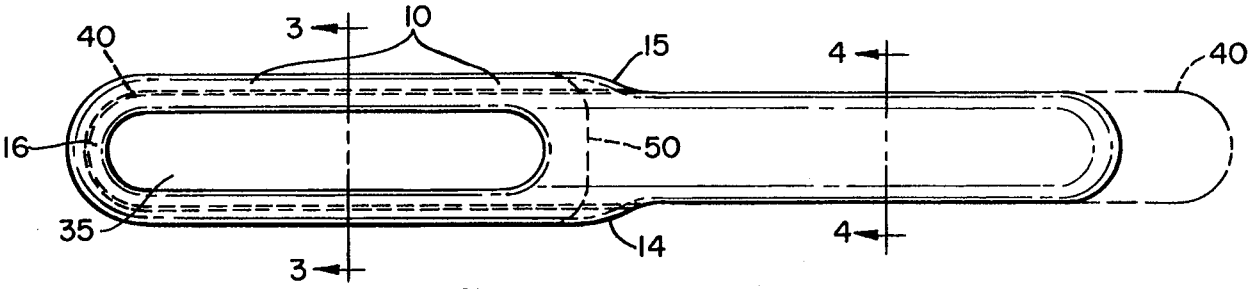
FIG. 2 shows a top side view of the File-Saver with a nail file inserted. Note the nail file is inserted in the Base-Handle of the File-Saver and extends beyond the Support-Extension of the File-Saver, and is represented by a dotted line.

FIG. 2, illustrates a top view of the File-Saver with a nail file (40) inserted. As reflected in FIG. 2, the Base-Handle (10) of the File-Saver is slightly wider than a nail file (40) (the nail file (40) being outlined by a dotted line in the drawing). The Support-Extension (20) in FIG. 2 is the same width as a nail file (40). The Top-Panel (16), Bottom-Panel (not shown in FIG. 2), Left-Side-Panel (14) and Right-Side-Panel (15), accurately taper inward to the width of the Support-Extension (20). The curve-dotted line (50) in FIG. 2 illustrates the location of the Slot's (30) opening on the File-Saver wherein a nail file (40) is inserted into the Base-Handle (10). FIG. 2 also better reflects where the said Oval-Opening (35) is located within the Top-Panel (16), with respect to the dimensions of the Top-Panel (16).

Figure 3:
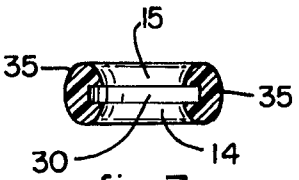
FIG. 3 illustrates a perspective view of the slot within the Base-Handle of the File-Saver, at the location on the File-Saver Base-handle marked by vertical line (A) in FIG. 2.

FIG. 3 illustrates a perspective view of the Slot (30), looking from within the Base-Handle (10)) at the location on the Base-Handle (10) marked by vertical line (A) in FIG. 2. FIG. 3 shows Slot (30) which is formed by Left-Side-Panel (14), Right-Side-Panel (15), Top-Panel (16) (not specifically shown in FIG. 3) and Bottom-Panel (17) (not shown specifically shown in FIG. 3). As previously stated, the Slot (30) is formed and sized in order for a nail file (40) to fit snugly into. The shaded areas illustrated on each side of Slot (30) in FIG. 3 represents the Oval-Openings (35) within the center of the Top-Panel (16) and Bottom-Panel (17) of the Base Handle (10).

Figure 4:
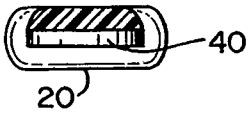
FIG. 4 illustrates a perspective view, at the point on the File-Saver as indicated by vertical line (B) in FIG. 2, and represents where the nail file rests against the Support-Extension of the File-Saver.

FIG. 4 illustrates a perspective view at the point on the File-Saver as represented by vertical line (B) in FIG. 2. FIG. 4 illustrates that view on the Support-Extension (20) whereon a nail file (40) rests and is supported. The shaded area illustrated in FIG. 4 represents the exposed section of the nail file (40) which is used for filing.

Figure 5:
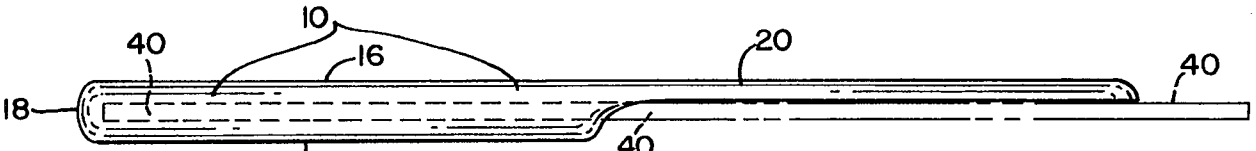
FIG. 5 is a perspective view of the side of the File-Saver with a nail file inserted. Note the nail file is inserted in the Base-Handle of the File-Saver and extends beyond the Support-Extension of the File-Saver, and is represented by a dotted line.

FIG. 5 illustrates a side view of the File-Saver with a nail file (40) inserted. FIG. 5 shows that the distance from the edge of the nail file (40) to the Top-Panel (16), is equal to the distance from the edge of the nail file (40) to the Bottom-Panel (17), as well as the Rear-Panel (18) which curves and accurately connects the Top-Panel (16) and Bottom-Panel (17). It should also be noted that the Rear-Panel (18) curves at the same degree as the inserted nail file (40).

Since the File-Saver is specifically designed for the size of a nail file (40), the manner of using the File-Saver is identical to that for using a nail file (40). Therefore there is no acclamation process for the User. However, a benefit continues to exist since by using the File-Saver, the Base-Handle (10) provides a comfortable handle for holding and controlling the nail file (40) while in use, and the Support-Extension (20) provides support to the nail file (40) in use by extending from the Base-Handle (10) along the back of the exposed nail file (40), thereby preventing the nail file (40) from cracking and breaking.

It will be apparent that the File-Saver can be made for any size width or length nail file (40). It should be equally apparent, by those skilled in the present art, that the present invention may be modified to support nail files that are not curved but squared at the ends. Therefore, various changes may be made to support any size or shape nail file (40) without departing from the scope of the invention and the invention is not to be considered limited to what is shown and described in this specification.

I claim:

1. A nail file protector comprising:

a base handle of strong, molded material, said base handle having a first side panel and a second side panel opposing each other; a top panel and a bottom panel bordering said first and second side panels and a slot formed between said panels, said slot being sized and shaped to receive a non-metallic nail file;

said second side panel having a longer length than said first side panel in a longitudinal direction thereof, said longer length forming a support extension which extends along an inserted non-metallic nail file to provide support and rigidity to the inserted nail file and leaving a first filing surface of said nail file exposed while substantially covering a second filing surface of the nail file.

2. A nail file protector device as in claim 1, wherein said support extension is of equal width and thickness as a non-metallic nail file, and said support extension provides means for preventing the non-metallic nail file from bending excessively or breaking when in use by providing a support means to the nail file in use.

* * * * *